US005448347A

United States Patent [19]

Mills

[11] Patent Number: 5,448,347

[45] Date of Patent: Sep. 5, 1995

[54] FUSER SKIVE MOUNT

[75] Inventor: Borden H. Mills, Webster, N.Y.

[73] Assignee: Eastman Kodak Company, Rochester, N.Y.

[21] Appl. No.: 234,081

[22] Filed: Apr. 28, 1994

[51] Int. Cl.[6] ..... G03G 21/00

[52] U.S. Cl. ..... 355/315; 271/307; 271/900

[58] Field of Search ..... 355/282, 285, 315; 271/307, 311, 900; 219/216; 432/60

[56] References Cited

U.S. PATENT DOCUMENTS

| | | | |
|---|---|---|---|
| 4,281,623 | 8/1981 | Kato et al. | 118/668 |
| 4,336,992 | 6/1982 | Szlucha et al. | 355/285 |
| 4,408,757 | 10/1983 | Yarm | 432/60 X |
| 4,755,848 | 7/1988 | Tamary | 355/315 |
| 4,893,146 | 1/1990 | Tachibana et al. | 355/315 |
| 4,929,983 | 5/1990 | Barton et al. | 355/315 |
| 5,053,830 | 10/1991 | Arai | 355/290 |
| 5,160,130 | 11/1992 | Fromm et al. | 271/307 |
| 5,241,354 | 8/1993 | Flynn | 355/315 |
| 5,245,395 | 9/1993 | Pawlik et al. | 355/315 |
| 5,293,202 | 3/1994 | Adachi et al. | 355/282 |

*Primary Examiner*—William J. Royer
*Attorney, Agent, or Firm*—Leonard W. Treash, Jr.

[57] ABSTRACT

A skive for a pressure roller fuser separates a receiving sheet that has a tendency to stick to one of the rollers in the fuser. The skive includes a finger having a tip which is spring urged against the roller. A mount for the finger permits the tip to move along the periphery of the roller in response to a difficult-to-separate sheet. The skive continues to attempt to separate the sheet without further pushing the tip into the roller. A guide surface on the finger continues to be directed by the mount toward a desired post-fuser path for the receiving sheet despite movement of the tip along the roller.

12 Claims, 4 Drawing Sheets

FUSER SKIVE MOUNT

This invention relates to a skive for separating a receiving sheet from a roller in a pressure roller fuser.

U.S. Pat. Nos. 4,281,623, granted Oct. 4, 1981 to Kato et al; 4,893,146, granted to Tachibana Jan. 9, 1990; 4,929,983, granted to Barton et al May 29, 1990; 5,053,830, granted to Arai Oct. 1, 1991; and 5,245,395, granted to Pawlik Sep. 14, 1993 are representative of a large number of references showing conventional roller fusers. A receiving sheet carrying a loose toner image is fed into a nip between a pair of rollers. Usually the roller contacting the toner image is heated and is called the "fusing roller". One of the rollers is softer than the other, forming a curved nip. The combination of heat and pressure fixes the toner image to the receiving sheet. As the receiving sheet exits the nip, it can have a tendency to stick on the periphery of either roller. Typically, it sticks to the fusing roller because of the tendency of the soft toner on that side of the sheet to cause adherence.

All of the above references show a set of stripping fingers or skives mounted with a pointed separating tip in contact with one or each of the rollers to separate the leading edge of the receiving sheet from the periphery of that roller. Gouging of a soft fusing roller by the skive is a continual problem with such devices. Many skives have a rigid finger with the separating tip resting against the roller. The finger has a remote pivot. The tip is held by a compression or torsion spring against the surface. An alternate structure includes a rigid mounting without a pivot but with a flexible finger whose resilience holds it against the roller surface. In either instance, contact with the leading edge of the receiving sheet will urge the skive into the roller unless the receiving sheet separates immediately.

The skive usually has a surface extending from the tip of the skive toward the desired path of movement of the receiving sheet which guides the receiving sheet downstream, generally to a pair of post-fuser rollers. It is important that this surface accurately feeds the sheet along its desired path to avoid jams.

SUMMARY OF THE INVENTION

It is an object of the invention to provide a fuser for fixing a toner image to a receiving sheet as the receiving sheet moves in a first direction along a path, which fuser includes first and second rollers engageable to form a fusing nip and a skive for separating the receiving sheet from one of the rollers, which skive is less likely to gouge the roller in response to engagement with a receiving sheet that is difficult to separate.

This and other objects are accomplished by means for applying a force to the skive to urge a separating tip of the skive into engagement with the periphery of the roller and means for permitting movement of the tip of the skive along the periphery of the roller in response to engagement with the receiving sheet without increasing the force of the skive into the roller.

According to a preferred embodiment, the mount further includes a guide surface extending from the separating tip to an end remote from the tip and further along the path of the sheet. The mount is designed to maintain the remote end of the surface aligned with the intended path of the sheet though the tip moves along the roller periphery.

According to another preferred embodiment, the tip of the skive moves first with the leading edge of a sheet that refuses to separate along the roller periphery and finally away from the periphery, allowing the sheet to pass rather than gouge the roller in a further effort to separate the sheet.

With the preferred embodiments, if the sheet is not immediately stripped when engaging the skive, the skive moves with the leading edge of the sheet while continuing to attempt to strip the sheet, but without being pushed by the leading edge of the sheet into the roller periphery. If the sheet still does not separate, the skive leaves the periphery, allowing the sheet to pass. This action provides a high chance of separating while greatly reducing the danger of the skive gouging the roller. At the same time, the mount maintains the orientation of the surface guiding the sheet in a direction consistent with the intended path of the sheet so that the sheet does not miss the nip of a pair of post-nip rollers or other downstream sheet handling components.

DESCRIPTION OF THE PREFERRED EMBODIMENTS

Figure 1:
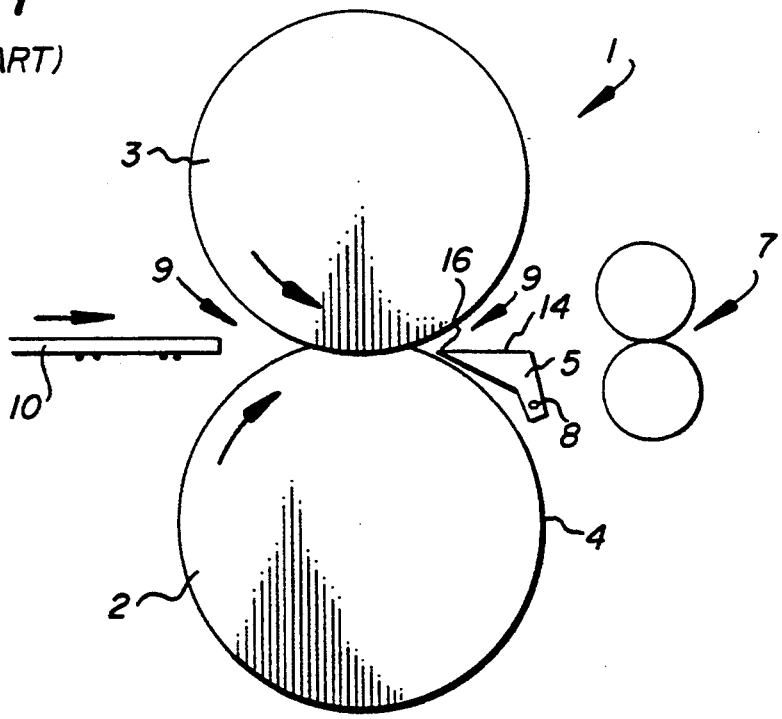
Fig. 1 (PRIOR ART)
FIG. 1 is a side schematic of a conventional fuser.

FIG. 1 shows a conventional fuser 1. A fusing roller 2 engages a pressure roller 3 forming a fusing nip 9. The rollers are rotatable to drive a receiving sheet 10 through the nip 9 and generally along a path, eventually exiting the fusing area through post-nip rollers 7. Receiving sheet 10 has a toner image on its lower side which contacts the fusing roller 2. The fusing roller 2 is heated, and the combination of pressure and heat in the nip 9 fixes the toner image to the receiving sheet 10.

As the receiving sheet exits the nip 9, it has a tendency to stick to a periphery or peripheral surface 4 of fusing roller 2 because of the adhesion of the toner to both the periphery 4 and the receiving sheet 10. This is partially countered by a pressure roller 3 which is harder than the fusing roller 2 which provides a shape to the nip 9 resisting such adhesion.

However, the receiving sheet can stick to either roller. A conventional skive 5 is located in the exit portion of nip 9 to help strip the receiving sheet from the periphery 4 of fusing roller 2. A similar skive can be located against pressure roller 3 to prevent sticking to that roller as well. Although only a single skive is shown, several are located across the path of sheet 10.

Typically, the skive 5 has a tapered end or tip 16 which rests against periphery 4 to separate the sheet and guide it along a guide surface 14 which, in all the figures is the top surface of skive 5. If the skive is rigid, it is urged by a compression or torsion spring in a counterclockwise direction around a pivot 8 to hold tip 16 against surface 4. The skive itself can also be resilient, obviating the need for a separate spring.

Such skives are extremely common and work quite well in most instances. An occasional problem with them is that when they encounter a sheet that is particularly difficult to separate, the force of the sheet against the tip pushes the tip into the roller and eventually causes gouging of the roller.

Referring to FIGS. 2–6, a skive 15 provides better separation with less risk of gouging while maintaining an effective guide path for the separated sheet. Like the prior art, skive 15 includes a rigid finger 17 having a tip 16 for engaging periphery 4 at a contact position and a sheet guide surface 14 extending from the tip to a position remote from the tip but along the path of the receiving sheet toward post-fuser rolls 7.

Figure 4:
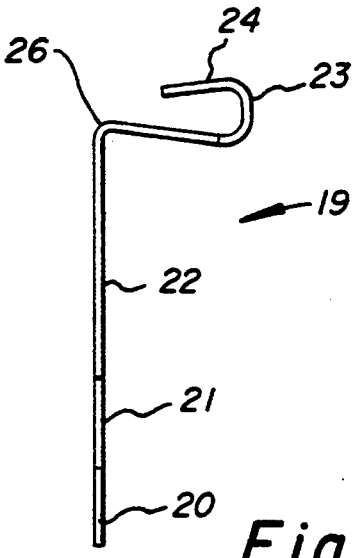
FIGS. 4, 5 and 6 are side, front, and top views, respectively, of a flexure member of the skive shown in FIGS. 2 and 3.
Figure 5:
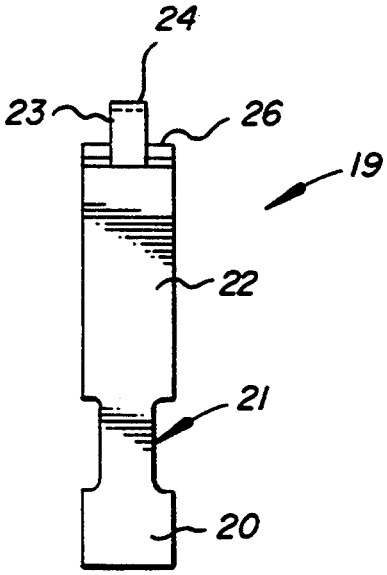
Figure 6:
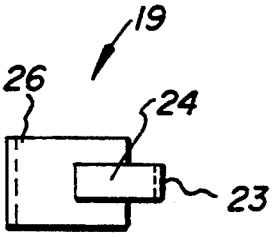

Finger 17 is supported by a flexure member 19. Flexure member 19 can be made out of relatively thin, resilient, metal shim stock. As seen in FIGS. 4, 5 and 6, flexure member 19 includes a mounting tab 20 at a first end of the flexure member for fixing the skive to a base in the fuser housing. The rest of the flexure member is cantilevered from the mounting tab. It includes a relatively straight portion 22 extending from the tab to a loop formed by a first bend 26 away from the contact position with the fusing roller and then a reversing bend 23 back toward the contact position. The finger 17 attaches to a second end 24 of flexure member 19 and, when not in contact with a fusing roller, rests on the top of the first bend 26.

When tab 20 is mounted in the apparatus in the absence of a fusing roller, flexure member 19 rests against a positioning bar or stop 98 with finger 17 resting on the top of bend 26. Flexure member 19 includes a thin portion 21, allowing resilient flexing of the extended straight portion 22 near tab 20. It is also thin around reversing bend 23, allowing resilient flexing at that position as well. When a fusing roller is inserted in the apparatus, flexing at reversing bend 23 in response to contact between tip 16 and the fusing roller periphery 4 lifts the finger 17 off the top of bend 26. The skive is now in the position A shown in FIG. 2, with the straight portion 22 still resting against stop 98. As a receiving sheet approaches skive 15 on periphery 4 of fusing roller 2, it engages tip 16. If it is immediately released, it then passes along surface 14 to post-fuser rolls 7. However, if the sheet is held more tightly to periphery 4, its leading edge exerts a force on skive 15 which causes skive 15 to bend at thin portion 21 and tip 16 to move along periphery 4 with the leading edge of the receiving sheet. While it is moving along the periphery 4, tip 16 continues to exert a separating force on the leading edge of sheet 10 (as the skive moves through positions B and C shown in phantom in FIG. 2). This flexing movement of the skive permits the skive to essentially give with the receiving sheet rather than imposing a rigid force into the roller 2 having a tendency to gouge periphery 4. Some force is also exerted resiliently by bend 23 generally causing finger 17 to move downward toward bend 26. As shown in FIG. 3, once the finger 17 actually reaches bend 26, further movement of tip 16 moves finger 17 away from periphery 4 (shown in phantom), allowing the sheet to pass underneath the finger rather than further increase the force of the tip 16 into the fusing roller 2. Note that the end of guide surface 14 most remote from separating tip 16 continues to be aimed at the nip formed by post-fuser rolls 7 so that the guide surface 14 continues to effectively direct the receiving sheet on its appropriate path.

Note that in this embodiment, the thinness of the flexure member around reversing bend 23 provides most of the loading force for the tip of the finger against the fusing roller. The flexure mounting 19, by virtue of the two narrow sections, will simulate the actions of two springs, one of low rate, to generate the tip load and one of medium rate to position the tip itself. The rest of the flexure member can either be rigid or slightly deflective because of its thickness. During normal operation, including idling of the fuser or skiving copies which release easily, the skive tip should remain in position A. To accomplish this, the deflection of the flexure member exceeds the frictional force of the skive tip against the fusing roller and the frictional force of copies against guide surface 14, so that the net force of the flexure member against the positioning bar 18 is always positive.

When the force between the skive tip and the fuser roll is exceeded because of a hard-to-separate sheet, the moment generated about the flexure mounting point will cause the flexure to rotate in a clockwise direction to position B. As the flexure deflects, the skive positioning load increases. The skive tip remains loaded against the fusing roller but at a decreasing load, since the deflection of the tip loading portion of the flexure member is decreased as the tip moves down the fusing roller (as shown). Thus, the skive flexure mounting allows the skive to deflect so that skiving need not occur instantaneously.

In addition, as the flexure member deflects, the angle of the upper guide surface 14 changes as the tip 16 follows the periphery of the fusing roller. This angle change keeps the lead edge of a separated sheet still directed toward the post-fuser rolls, as shown by positions B and C in FIG. 2.

Figure 2:
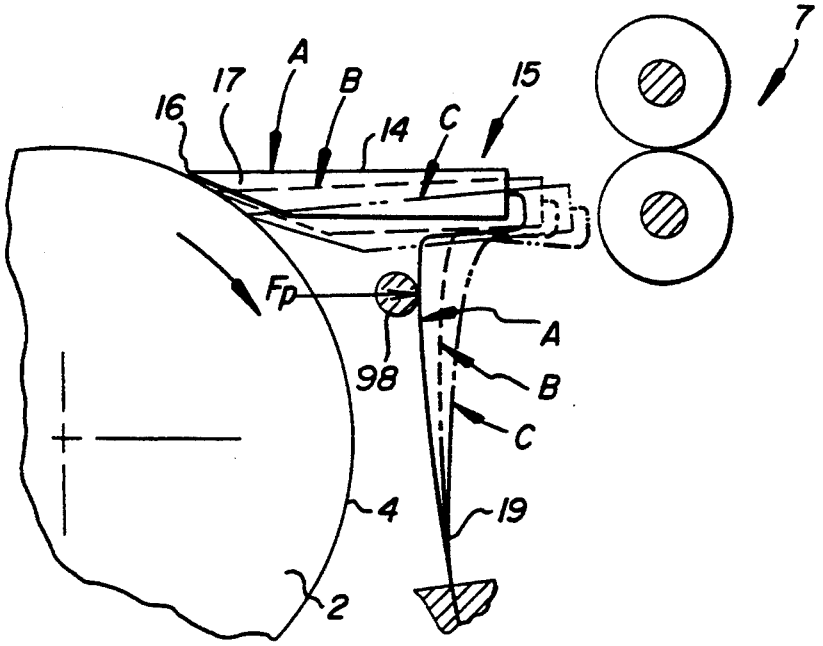
FIGS. 2 and 3 are side schematics of a portion of the fuser illustrating various positions of a skive in a single separating action.
Figure 3:
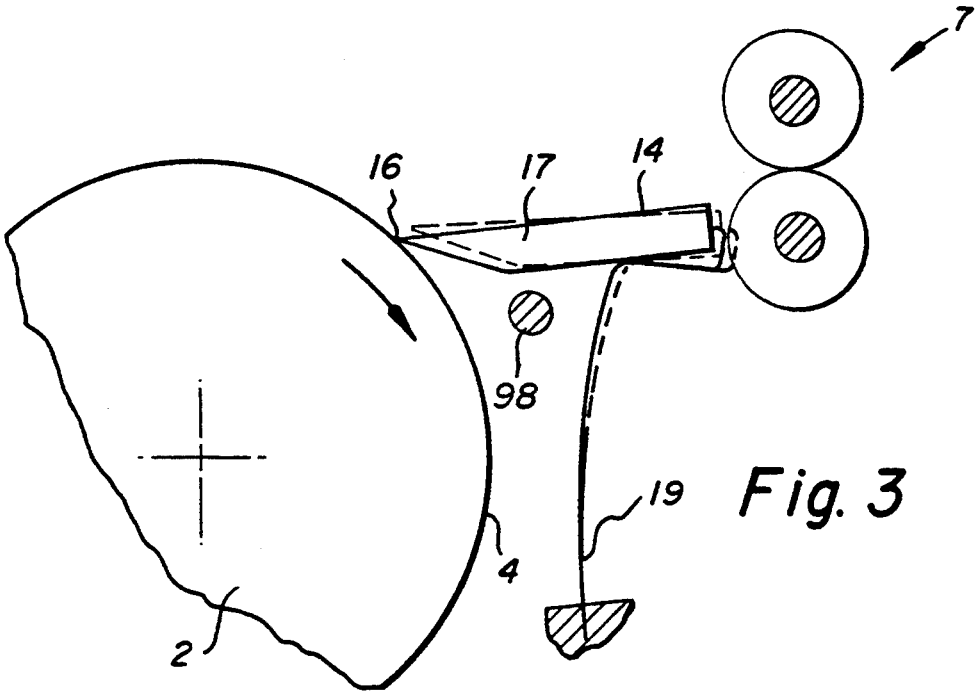

When the skive tip 16 is deflected as far as position C in FIG. 2, the finger will contact the flexure member at first bend 26. At this point, the skive tip load will approach zero. In addition, the flexure member will now act as a single spring flexing at portion 21 so that the skive position can continue to change if even more force is applied by the receiving sheet. Further deflection of the positioning portion of the flexure member will cause the skive tip to lose contact with the fuser roller surface, as shown in FIG. 3. This eliminates damage to the fuser roller, even though it permits the receiving sheet to go on around the roller.

Figure 7:
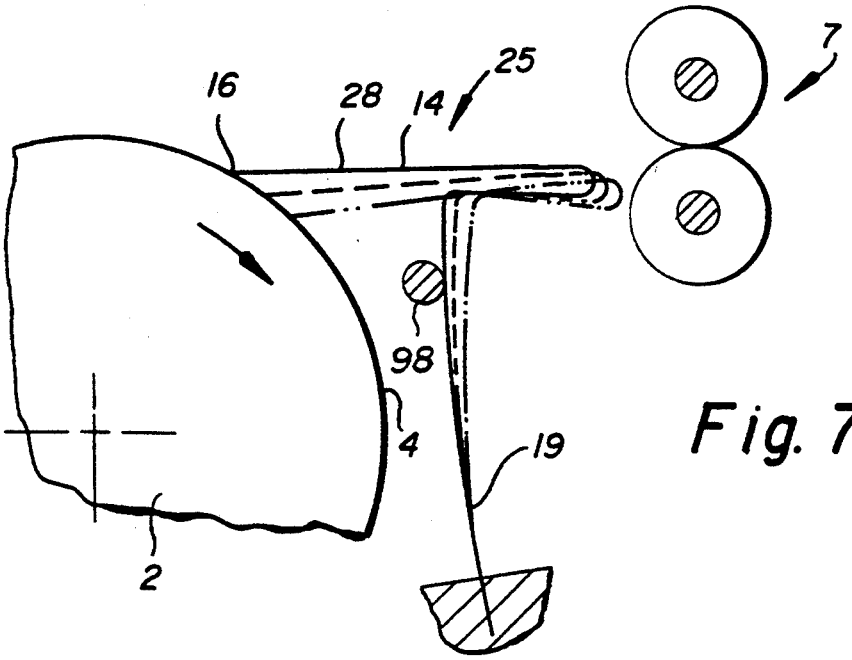
FIG. 7 is a side schematic illustrating an alterative skive similar in construction and operation to that shown in FIGS. 2–6.

FIG. 7 illustrates a skive 25 which is essentially the same as skive 15, except that instead of having a rigid plastic finger, it has a thin metallic finger 28 also made out of conventional shim stock. Preferably, finger 28 is sufficiently thick to be rigid and operate in essentially the same manner as rigid finger 17. However, some flexing in finger 28 could readily be allowed for in design.

Figure 8:
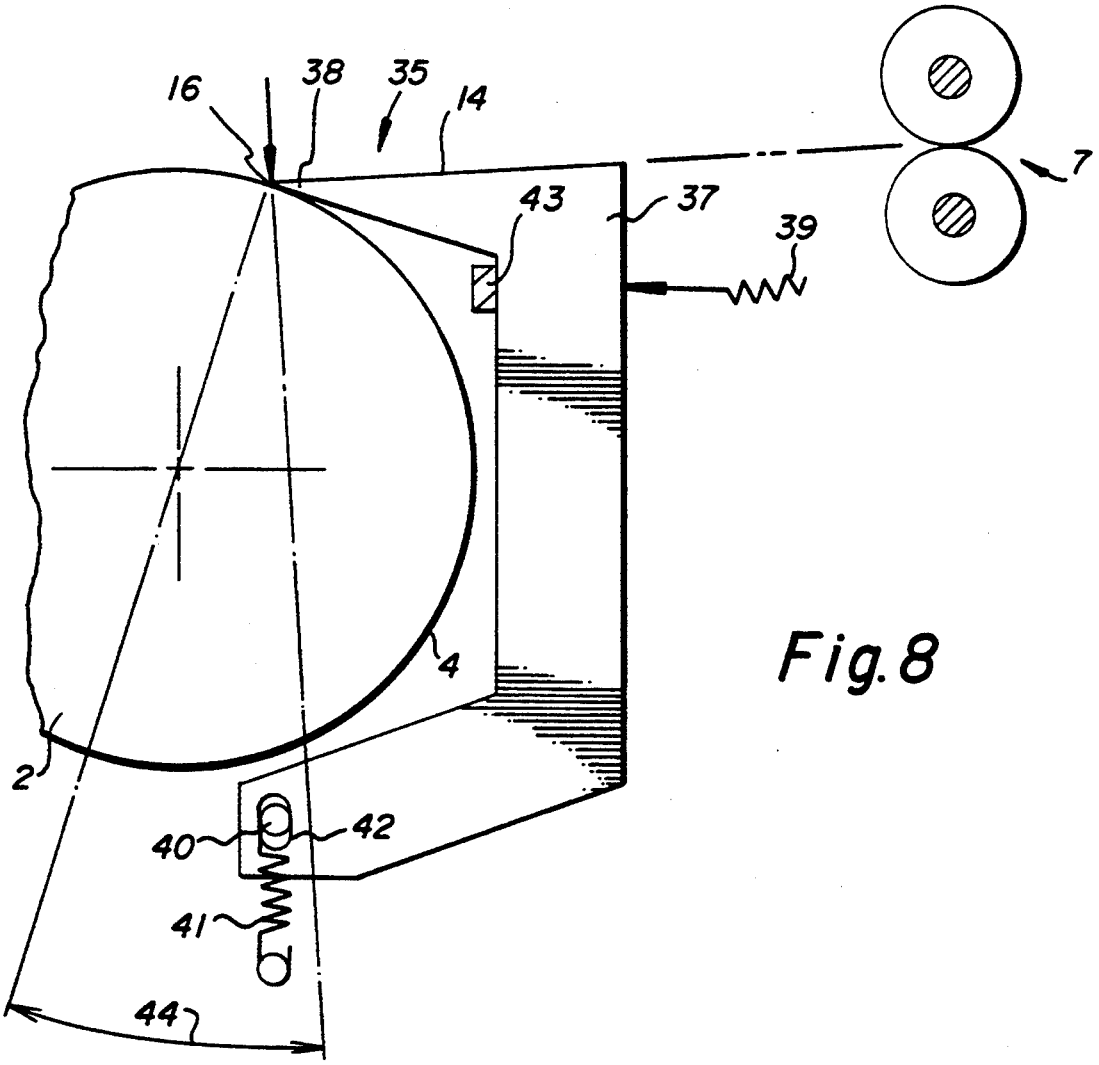
FIGS. 8, 9 and 10 are side schematics of a portion of a fuser illustrating alternative skives.

FIG. 8 shows an alterative skive 35 which is formed as a single unitary plastic member 37 urged by a compression spring 39 against a locating pad or stop 43. Unitary member 37 is U-shaped with a finger section 38 having a tip 16 positioned to engage periphery 4 of fusing roller 2. Unitary member 37 pivots about a pin 40 located in a slot 42 in member 37. A extension spring 41 associated with slot 42 cooperates with extension spring 39 to maintain tip 16 against periphery 4 and stop 43. As in the other embodiments, as a receiving sheet engages tip 16 and refuses to separate, member 37 has a tendency to pivot around pivot 40. Within the length of slot 42 tip 16 maintains contact but moves along the periphery 4 as it continues to apply a separating force to the sheet. If pivot 40 is positioned in an antigouge pivot angle 44, generally opposite the tip 16, no additional force into the roller is applied by engagement of tip 16 with the sheet. Eventually, either the sheet separates or the tip 16 separates from roller periphery 4.

Thus, this embodiment has some of the advantages of the other embodiments in terms of engagement between the receiving sheet and the tip not adding force tending to gouge the roller and movement of the tip along the roller periphery to attempt to continue to release the sheet as the force of the sheet increases. It has a disadvantage the other embodiments do not have. As member 37 pivots around pivot 40, surface 14 points away from the desired path of the receiving sheet, increasing the risk of a jam at the post-fuser drive rolls 7. This can be corrected by the addition of additional guide structure to maintain that path. In the other embodiments, the mount for the skive assures orientation of surface 14 toward-the post-fuser drive rolls as the tip moves along the periphery 4.

Figure 9:
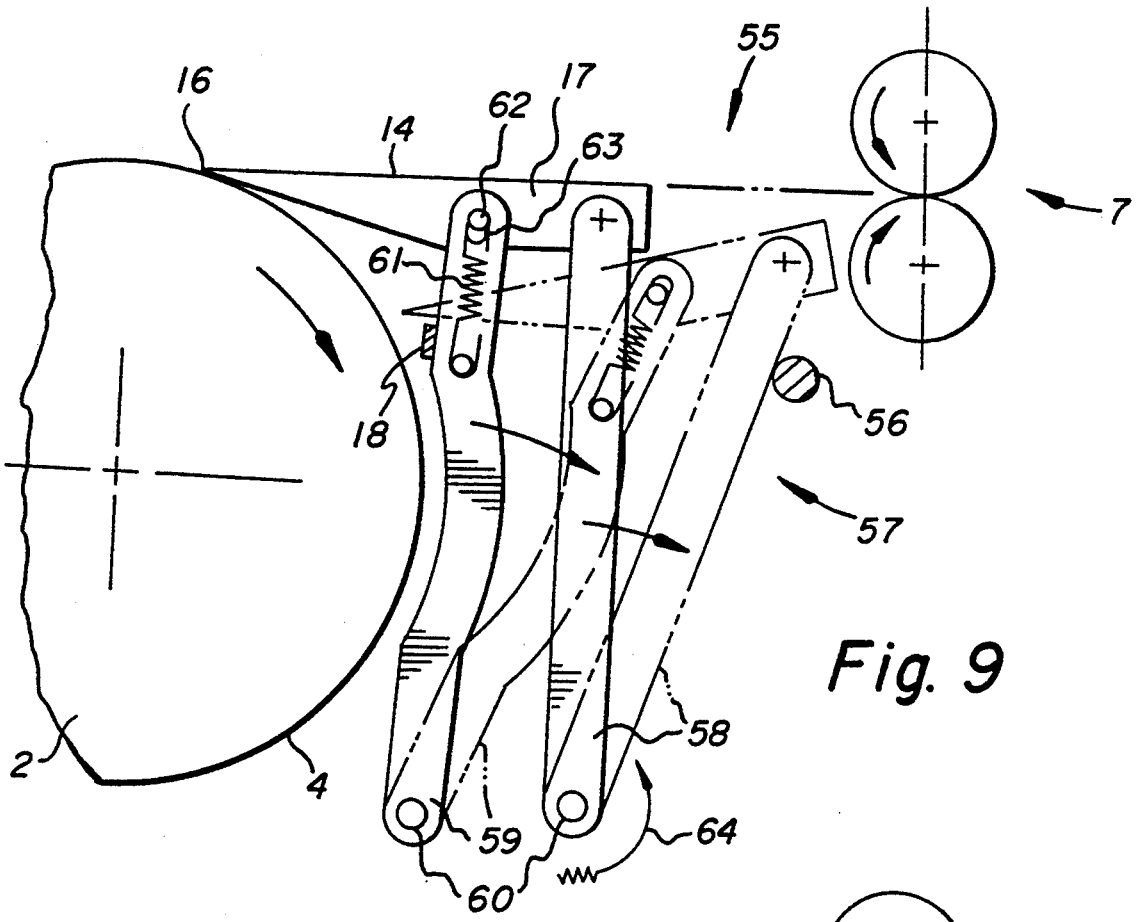
Figure 10:
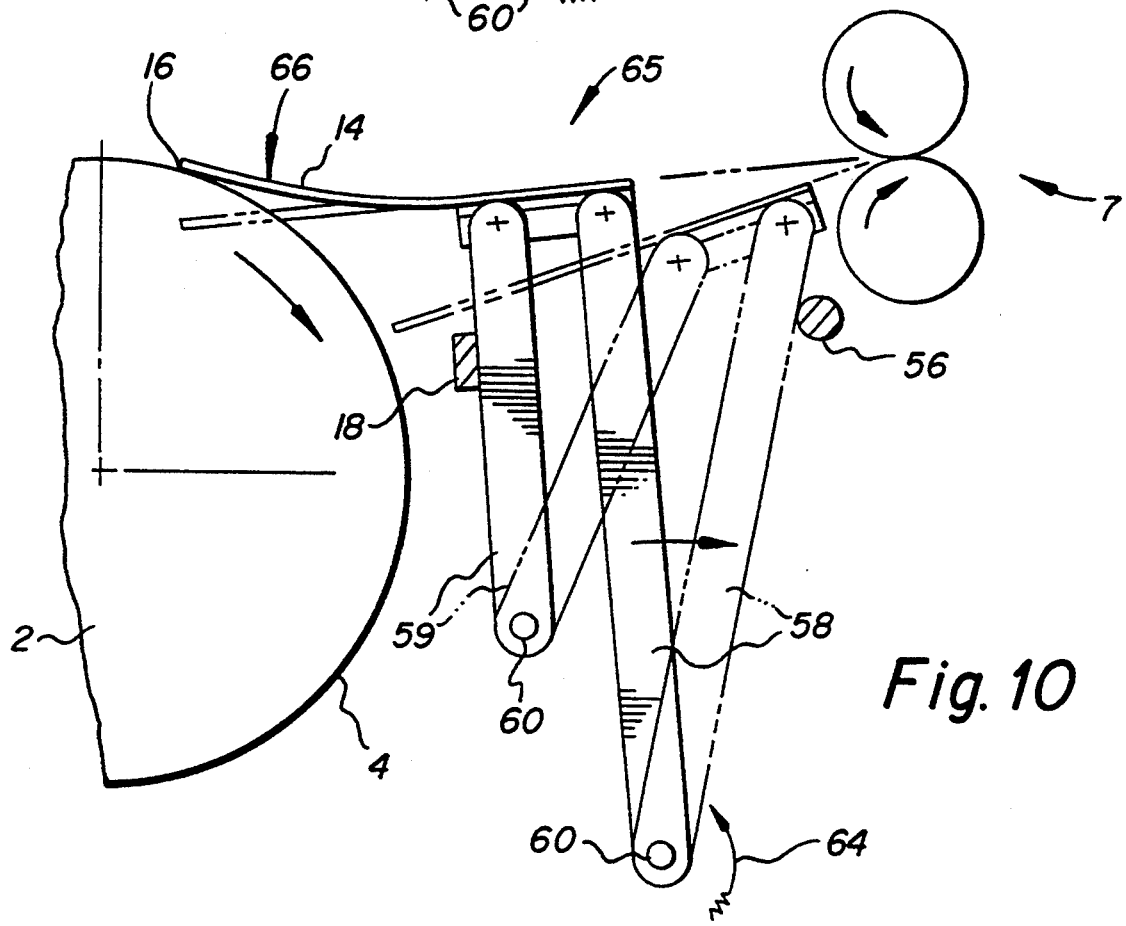

FIGS. 9 and 10 show skives 55 and 65, respectively, using "four bar" linkages to assure both an antigouge skive reaction to a receiving sheet and also orientation of the sheet toward the post-fuser path. Referring to FIG. 9, skive 55 includes a rigid finger 17 and a four bar linkage 57 made up of a rear bar 58 and a front bar 59. Bars 58 and 59 are mounted for rotation about shafts 60 secured between the mechanism plates of the fuser. Opposite ends of the bars 58 and 59 are secured to rigid finger 17 and are also rotatable with respect to it. The front bar 59 has a slot 63 which fits around a pin 62 in finger 17. A extension spring 61 between pin 62 and bar 59 provides most of the force holding tip 16 against fusing roller periphery 4. Torsion springs 64 around one or both of shafts 60 urge one or both of bars 58 and 59 in counter-clockwise directions, urging the linkage 57 toward locating pad or stop 18. The length of the bars is chosen according to conventional four bar linkage design so that the force of a receiving sheet that is difficult to release, on tip 16 moves tip 16 first along the periphery 4 and ultimately, in response to increased force from reluctance to separate, away from periphery 4 without increasing the force of the tip against the roller. The linkage also controls the portion of finger 17 remote from tip 16 so that guide surface 14 is always aligned with the nip of post-fuser drive rolls 7. That is, although the pointed end 16 is moved substantially downward, as seen in phantom in FIG. 9, the rear end of the finger is moved only slightly downward and the surface 14 takes on an orientation angled upward toward the post-fuser drive rolls 7.

FIG. 10 shows skive 65 to be substantially the same as that shown in FIG. 9 except that the force on tip 16 is provided by a resilient finger 66 rather than by extension spring 61 (FIG. 9). Although this eliminates the need for slot 63 in bar 59, a slot and extension spring could be provided to assist the resilience of finger 66 in maintaining the tip force. Note that the relative length and orientation of the bars has been changed somewhat to allow for the different angle of surface 14, which is no longer straight. Note also in both FIGS. 9 and 10 the substantial movement of end 16.

FIGS. 2, 7, 9 and 10 all show the normal, or separating, position is of the skives in normal illustration with the other positions of the skive responding to a difficult-to-separate sheet in phantom.

Although the invention has been illustrated with respect to skiving a receiving sheet off a compliant fusing roller, it could be used to skive a sheet off either or both rollers, regardless of the relative compliance of the rollers.

Although the FIGS. show the skives only in their side view, the tips of the skive are not generally points but rather separating ends that taper toward a line. Although each skive is shown as a single skive, it is generally one of a set of skives mounted on a single or multiple bars or other holding devices extending in a crosstrack direction across the path of movement of the receiving sheets. For example, shafts 60 in FIGS. 9 and 10 would include multiple sets of four bar linkages. Each finger could have a separate linkage on each side with the finger located between the linkages or a single linkage on one side or the other with the finger cantilevered from the linkage.

Note that all the skives disclosed include improved release and reduced gouging as the tip moves along the periphery of the roller with the sheet. The design shown in FIG. 8 has the above advantages but with the disadvantage that the guide surface 14 has a tendency to misalign as the tip rotates around the periphery in response to a difficult-to-separate sheet. The other embodiments all allow for this movement of the tip by maintaining the more remote end of the guide surface 14 aligned with the expected post-fuser path of the receiving sheet.

The invention has been described in detail with particular reference to a preferred embodiment thereof, but it will be understood that variations and modifications can be effected within the spirit and scope of the invention as described hereinabove and as defined in the appended claims.

I claim:

1. A fuser for fixing a toner image to a receiving sheet as the receiving sheet moves in a first direction along a path, said fuser comprising:

first and second rollers engageable to form a fusing nip and rotatable to drive the receiving sheet in the first direction through the nip to fix the toner image, the first roller having a periphery that contacts the receiving sheet, a skive for separating the receiving sheet from said periphery, said skive having a tip for engaging a leading edge of the receiving sheet to strip the receiving sheet from said periphery, and mounting means, which mounting means includes means for applying a force to the skive to urge the tip into engagement with said periphery, means for permitting movement of the tip along the periphery in response to engagement with the leading edge of a receiving sheet that is difficult to separate from the periphery, and means for separating the tip from the periphery in response to engagement of the tip and the receiving sheet after the tip has first moved along the periphery in response to such engagement.

2. A fuser according to claim 1 wherein said mounting means further includes means for reacting to engagement of the tip and the receiving sheet without increasing the force of the tip into the periphery of the first roller.

3. A fuser according to claim 1 further including means defining a post-fusing nip path for the receiving sheet and wherein said mounting means is constructed to maintain that path as the tip moves along the periphery of the first roller.

4. A fuser according to claim 3 wherein the skive includes means defining a guiding surface for guiding a separated receiving sheet from the tip to a position remote from the tip along the post-fusing nip path, said guiding surface having a first orientation when no sheet is being separated and a second orientation when the tip has moved along the periphery of the first roller, which second orientation is angularly rotated from the first orientation with the tip being displaced more than the rest of the guiding surface so that the guiding surface continues to guide a receiving sheet along the post-fusing nip path.

5. For use in a fuser having first and second rollers for fixing a toner image to a receiving sheet as the receiving sheet moves in a first direction along a path, a skive for separating the receiving sheet from a periphery of one of the rollers, said skive comprising:

a finger portion for contacting said periphery at a contact position, a flexure member including a first end fixed in a base from which the flexure member is cantilevered, a second end which defines the finger portion or to which the finger portion is attached, a relatively straight portion extending from the first end, a first bend, transverse to the straight portion and extending away from the contact position, and a reversing bend extending from the first bend first away from the contact position and then toward the contact position and the second end, the reversing bend and at least a portion of the straight portion being resiliently flexible to maintain the finger portion in contact with the periphery while allowing an increased force from a difficult-to-separate receiving sheet engaging the finger portion to move the finger portion along the periphery.

6. A skive according to claim 5 wherein the finger portion defines a guide surface for a separated receiving sheet which guide surface extends away from the periphery toward and aligned with a pair of post-fuser rolls, said flexure member maintaining the guide surface aligned with the rolls while the finger portion is moved along said periphery by a difficult-to-separate receiving sheet.

7. A skive according to claim 5 wherein said flexure member is constructed of a single thin metallic sheet having portions thinned to increase their flexibility adjacent the first end and throughout the reversing bend.

8. A skive according to claim 7 wherein the shape and resiliency of said reversing bend causes the finger portion to rest against a portion of the first bend when the skive is not engaging the periphery but permits separation between the finger portion and said portion of the first bend when the finger portion is resting against the periphery providing a force maintaining the finger portion in contact with the periphery.

9. A skive according to claim 7 wherein said thin portions of said flexure member maintain said finger portion against said periphery without increasing the force of the finger portion into the periphery in response to engagement of the finger portion and a difficult-to-separate receiving sheet.

10. For use in a fuser having first and second rollers engageable and rotatable to drive a receiving sheet through a fusing nip to fix a toner image to the receiving sheet, a skive for separating the receiving sheet from a periphery of one of the rollers, said skive comprising:

a finger having a separating tip positionable in engagement with said periphery, and a four bar linkage supporting the finger, said linkage including means providing a force urging the tip against the periphery and permitting movement of the tip along the periphery in response to engagement with a difficult-to-separate receiving sheet without increasing the force of the tip against the periphery in response to engagement with the difficult-to-separate receiving sheet.

11. A skive according to claim 10 wherein the finger has means defining a guide surface for guiding a separated receiving sheet from the tip to an end of the guide surface remote from the tip, the four bar linkage being constructed to permit movement of the tip along the periphery without comparable movement of the remote end, thereby maintaining a path of movement of the receiving sheet after separation despite such movement of the tip.

12. For use in a fuser having first and second rollers engageable and rotatable to drive a receiving sheet through a nip for fixing a toner image to the receiving sheet, a skive for separating the receiving sheet from a periphery of one of the rollers, said skive comprising:

a single unitary U-shaped structure having a tip at the end of one leg of the U and a pivot for the structure at the end of the other leg of the U, the pivot being located sufficiently around the periphery from the tip that the force of a difficult-to-separate receiving sheet on the tip does not increase the force of the tip into the periphery, and resilient means urging the unitary U-shaped structure toward the periphery.

* * * * *